US005193621A

United States Patent [19]

Manke et al.

[11] Patent Number: 5,193,621

[45] Date of Patent: Mar. 16, 1993

[54] BYPASS VALVE

[75] Inventors: Kevin R. Manke, Flower Mound; Paul D. Ringgenberg, Carrollton, both of Tex.

[73] Assignee: Halliburton Company, Duncan, Okla.

[21] Appl. No.: 693,759

[22] Filed: Apr. 30, 1991

[51] Int. Cl.[5] ..... E21B 34/08

[52] U.S. Cl. ..... 166/386; 166/317; 166/332; 166/145

[58] Field of Search ..... 166/373, 375, 386, 317, 166/332, 334, 329, 320, 250, 145, 150

[56] References Cited

U.S. PATENT DOCUMENTS

| | | | |
|---|---|---|---|
| 2,740,479 | 4/1956 | Schwegman | 166/145 |
| 2,751,014 | 6/1956 | Johnston et al. | 166/145 |
| 3,066,738 | 12/1962 | Myers | 166/149 |
| 3,351,133 | 11/1967 | Clark, Jr. et al. | 166/334 X |
| 3,361,207 | 1/1968 | Chenoweth | 166/237 X |
| 4,270,610 | 6/1981 | Barrington | 166/317 |
| 4,281,715 | 8/1981 | Farley | 166/317 |
| 4,311,197 | 1/1982 | Hushbeck | 166/317 X |
| 4,319,633 | 3/1982 | McMahan et al. | 166/250 |
| 4,582,140 | 4/1986 | Barrington | 166/334 |
| 4,907,655 | 3/1990 | Hromas et al. | 166/332 X |
| 4,911,242 | 3/1990 | Hromas et al. | 166/317 |

*Primary Examiner*—William P. Neuder

*Attorney, Agent, or Firm*—C. Dean Domingue; L. Wayne Beavers

[57] ABSTRACT

A bypass valve for bypassing well fluids, and method of use thereof. The valve comprises a tubular housing defining a bypass port therethrough with an inner sleeve mandrel defining a bypass port initially aligned with the bypass port in the housing. The valve also comprises a power mandrel slidably disposed within the housing such that, as weight is set down on the power mandrel, pressure is increased in a first oil chamber which has a rupture disc in communiction therewith. When the pressure reaches a predetermined level, the rupture disc ruptures so that the oil chamber is emptied into the well annulus. This allows the power mandrel to move and strike an operating mandrel which is also slidably disposed in the housing. The jarring force shears a shear pin which allows the operating mandrel to move a floating piston disposed in a second oil chamber. A metering cartridge restricts flow of fluid out of the second metering chamber, thereby providing a time delay for movement of the operating mandrel. The operating mandrel eventually contacts the sleeve mandrel and moves it with respect to the housing so that the bypass ports are no longer aligned, thereby closing the valve.

19 Claims, 7 Drawing Sheets

BYPASS VALVE

BACKGROUND OF THE INVENTION

1. Field of the Invention

Generally, this invention relates to downhole tools for use in a well. In particular, but not by way of limitation, this invention relates to those tools utilizing a bypass to allow well fluids located below the tool to bypass the main fluid passages of the tool as the tool string is being stung into, or out of, a production packer.

2. Description of Prior Art

During the course of drilling an oil or gas well, one operation which is often performed is to lower a testing string into the well to test the production capabilities of the hydrocarbon producing underground formations intersected by the well. This testing is accomplished by lowering a string of pipe, commonly referred to as the drill pipe, into the well with a formation tester valve attached. Another tool typically run into the well is known as a Tubing String Testing Valve (TST), which is a full opening test valve that allows the drill stem test string to be pressure tested while running in the hole. The TST contains a flapper type valve which acts somewhat similar to a check valve. As the tool string is being run into the hole, the test string annulus can fill with fluid. However, if pressure is placed on the tubing string, the TST flapper valve will seat and seal, thereby allowing the string to be pressure tested. The pressure testing of the drill string can be accomplished as many times as desired.

Once the test string is run to its desired depth, it is then necessary to sting, via a set of seals located on the bottom of the test string, into the production packer. However, if it is necessary to pull the test string up, the TST flapper valve will act as a check valve, thereby causing a pressure decrease due to a increase in volume in the annulus below the TST flapper valve. This decrease in pressure can operate to affect the seals on the bottom of the test string, as well as the seals on the production packer itself.

Furthermore, if one of the other tester valves located in the test string have been closed for testing reasons, the pulling in and out of the seals can act to destroy the seal integrity on the stinger of the test string as well as effecting the seals in the production packer, by causing a piston effect due to the closed annulus area.

Several types of bypasses have been employed with use in drill stem testing. U.S. Pat. No. 2,740,479 to Schwegman provided a bypass which allowed fluid from below the formation tester to flow upward through the packer mandrel and through the lower end of the tester valve, then outward through a bypass port so that it could flow upward in the annulus between the tester valve and the wellbore in order to bypass the piston effect of the larger packer located below the tester valve.

Another example of such a bypass is seen in U.S. Pat. No. 4,582,140 to Barrington, assigned to Halliburton, assignee of the present invention. The Barrington device allowed a choice of several possible functions of that bypass tool In a first arrangement, a bypass is run into the wellbore in an open position and is then latched closed upon operation of the tool by setting down weight. In the second arrangement, the open bypass is run into the well, the bypass is closed by setting down weight; however, the bypass could reopen when the weight was picked up. Finally, the Barrington invention allowed the bypass port to be completely eliminated when it was desired to run the tool without bypass.

However, the bypass valves of the prior art do not deal with the bypass in which a TST valve has been utilized. Therefore, in reference to the present invention, there are several features not possible with the prior art bypass valves. One feature includes the fact that a rupture disk is utilized, said rupture disk being operable by transmitting pressure via an oil chamber to rupture the disk. Also, as an added feature there is included two sets of shear pins provided in the tool. One set of shear pins allows the activation of the time delay function of the present invention; the second set allows for the floating piston to begin its travel, and move the operating mandrel after a predetermined amount of oil has been metered out of the second oil chamber.

Another feature of the present invention utilizes a metering cartridge in order to implement its time delay. The metering cartridge utilizes a restriction, and the restriction size can be varied, hence directly effecting the amount of time necessary to meter the oil.

Also there is contained a recess neck on the operating mandrel, thereby effectively allowing the metering cartridge to be bypassed. When the recess neck of the operating mandrel reaches the metering cartridge, the flow of oil can bypass the metering cartridge, and allow rapid movement of the operating mandrel to import a jarring effect in the tool. Once this jarring effect is accomplished, the ported mandrel will effectively seal off the bypass ports. Furthermore, another feature of the invention is that once the bypass ports have been closed, hydrostatic pressure from within the tubing string will keep the ported mandrel in a closed position alleviating the need for a locking mechanism.

Another feature of the invention allows for pressure testing the seal of the ported mandrel before the test tool is run into the hole. Yet another feature includes having the oil in the second chamber as well as air in a separate chamber under atmospheric pressure, thereby allowing a differential pressure which the floating pistons can act against.

SUMMARY

The present well tool provides for a fluid bypass in a drill stem testing string. The well tool comprises a mandrel which is capable of transmitting force, such as weight, to an internal oil chamber. This force is then transmitted by means of a passage within the well tool to a rupture disk. The rupture disk can be set at varied rupture pressures, at the option of the operator.

Once the desired pressure has ruptured the disk, the mandrel will move up and jar a ported operating mandrel, exposing the port to hydrostatic tubing pressure. This hydrostatic tubing pressure will act on a floating piston contained within a second oil chamber which will force oil to an atmospheric air chamber; however, the flow of oil is delayed by means of a metering cartridge. This provides for a time delay.

After a predetermined amount of oil has been metered, the flow will become unrestricted, allowing for the jarring between the inner operating mandrel and the bypass ported mandrel, thereby effectively closing the bypass ports. Once in the closed position, there is no need for a locking mechanism because the tubing hydrostatic pressure will act to keep the ported mandrel in a closed position.

BRIEF DESCRIPTION OF THE DRAWINGS

The features of the present invention will be more fully understood from the following description and drawings wherein:

FIG. 6 comprises a section elevation taken along line 6—6 of FIG. 2.

OVERALL WELL TESTING ENVIRONMENT

Figure 1:
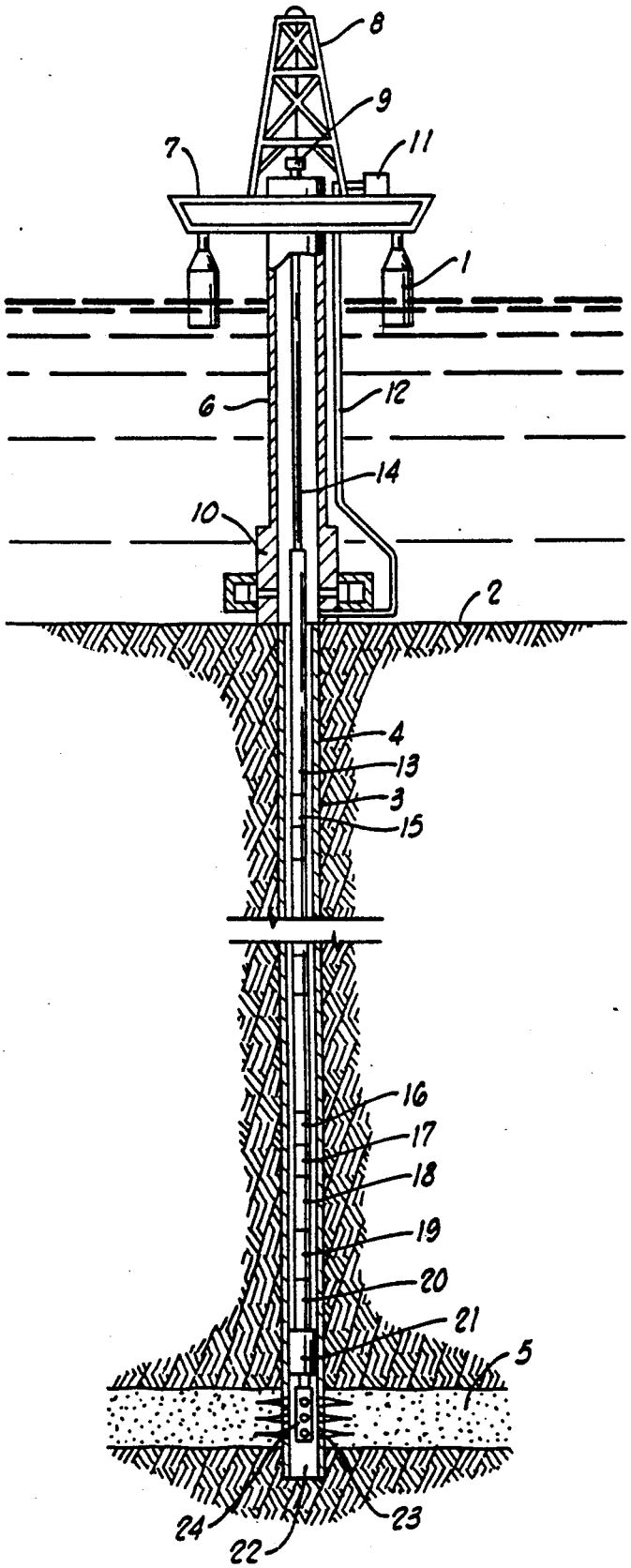
FIG. 1 provides a schematic vertically sectioned view of a representative offshore installation which may be employed for testing purposes and illustrates a formation testing "string" or tool assembly and position in a submerged wellbore and extending upwardly to a floating operating and testing station.

Referring to FIG. 1 of the present invention, a testing string for use in an offshore oil or gas well is schematically illustrated.

In FIG. 1 a floating work station 1 is centered over a submerged oil or gas well located in the sea floor 2 having a wellbore 3 which extends from the sea floor 2 to a submerged formation 5 to be tested. The wellbore 3 is typically lined by steel casing 4 cemented into place. A subsea conduit 6 extends from the deck 7 of the floating work station 1 into a wellhead installation 10. The floating work station 1 has a derrick 8 and a hoisting apparatus 9 for raising and lowering tools to drill, test, and complete the oil or gas well.

A testing string 14 is being lowered in the wellbore 3 of the oil or gas well. The testing string includes such tools as one or more pressure balanced slip joints 15 to compensate for the wave action of the floating work station 1 as the testing string is being lowered into place, a circulation valve 16, a tester valve 17 and the bypass valve of the present invention 19.

The slip joint 15 may be similar to that described in U.S. Pat. No. 3,354,950 to Hyde. The circulation valve 16 is preferably of the annulus pressure responsive type and may be as described in U.S. Patent Nos. 3,850,250 or 3,970,147. The circulation valve 16 may also be the reclosable type as described in U.S. Pat. No. 4,113,012 to Evans et. al.

The tester valve 17 is preferably the type disclosed in U.S. Pat. No. 4,429,748, although other annulus pressure responsive tester valves as known in the art may be employed.

A tubing string tester (TST) valve 18 as described in U.S. Pat. No. 4,328,866 which is annulus pressure responsive is located in the testing string above the bypass valve 19 of the present invention.

The tester valve 17, circulation valve 16 and TST valve 18 are operated by fluid annulus pressure exerted by a pump 11 on the deck of the floating work station 1. Pressure changes are transmitted by a pipe 12 to the well annulus 13 between the casing 4 and the testing string 14. Well annulus pressure is isolated from the formation 5 to be tested by a packer 21 set in the well casing 4 just above the formation 5. The packer 21 may be a Baker Oil Tools Model D packer, the Otis type W packer, the Halliburton Services EZ Drill ® SV packer or other packers well known in the well testing art.

The testing string 14 includes a tubing seal assembly 20 at the lower end of the testing string which "stings" into or stabs through a passageway through the production packer 21 for forming a seal isolating the well annulus 13 above the packer 21 from an interior bore portion 22 of the well immediately adjacent the formation 5 and below the packer 21.

By-pass valve 19 relieves pressure built up in testing string 14 below tester valve 17 as seal assembly 20 stabs into packer 21.

A perforating gun 24 may be run via wireline to or may be disposed on a tubing string at the lower end of testing string 14 to form perforations 23 in casing 4, thereby allowing formation fluids to flow from the formation 5 into the flow passage of the testing string 14 via perforations 23. Alternatively, the casing 4 may have been perforated prior to running testing string 14 into the wellbore 3.

A formation test controlling the flow of fluid from the formation 5 through the flow channel in the testing string 14 by applying and releasing fluid annulus pressure to the well annulus 13 by pump 11 to Operate circulation valve 16, tester valve 17, and check valve 18 and measuring of the pressure build up curves and fluid temperature curves with appropriate pressure and temperature sensors in the testing string 14 is fully described in the aforementioned patents.

DETAILED DESCRIPTION OF THE PREFERRED EMBODIMENT

In the description which follows, like parts are generally marked throughout the specification and drawing with the same reference numerals, respectively.

The production packer bypass valve generally comprises a tubular housing member, first power mandrel, a second operating mandrel, means for jarring the first mandrel, means for restricting the flow of oil to an atmospheric chamber, an inner operating mandrel, a ported bypass mandrel, and means for impacting the ported bypass mandrel.

Figure 2A:
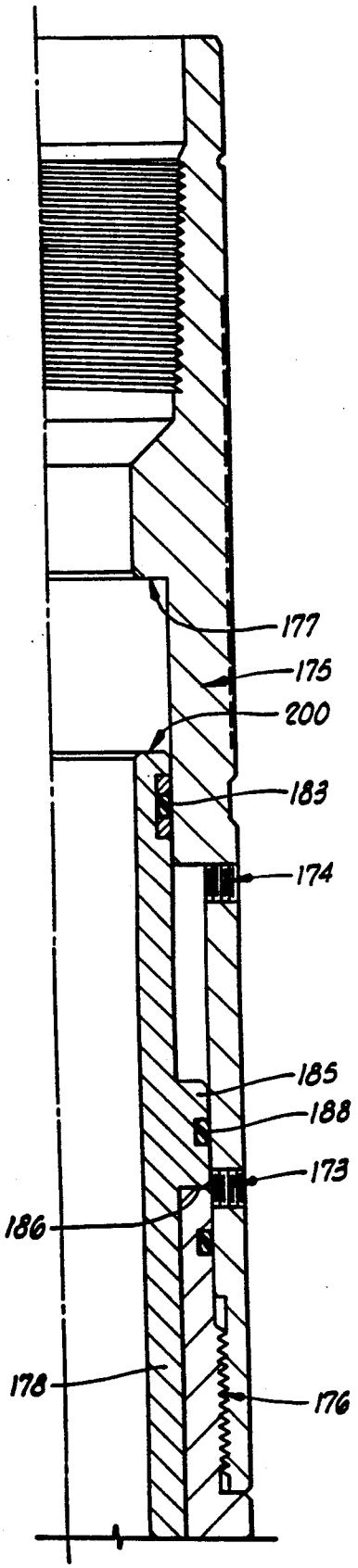
FIGS. 2A-2E comprise a vertical quarter-section elevation of the production packer bypass valve of the present invention, with bypass ports in the open position.
Figure 2B:
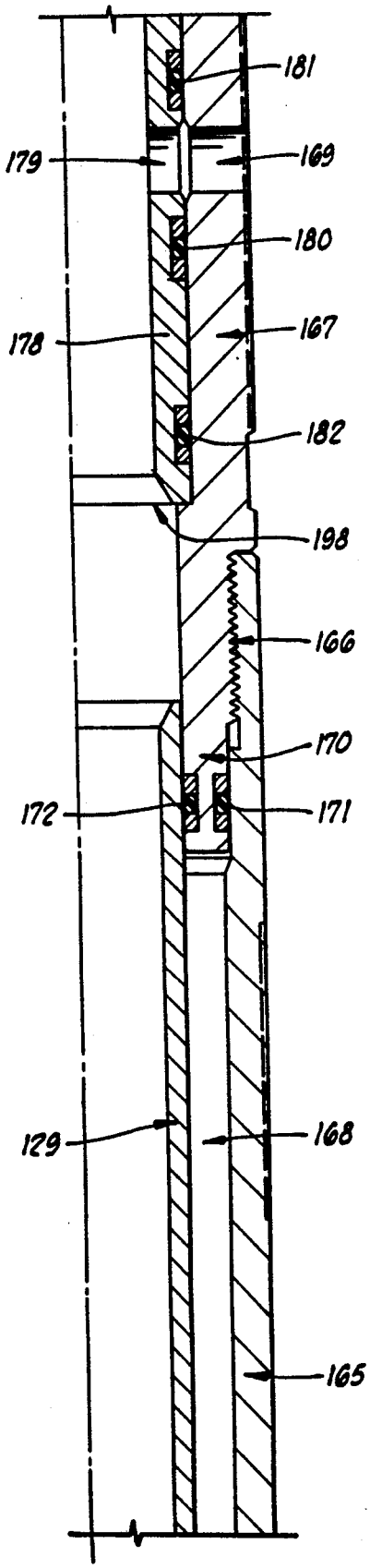
Figure 2C:
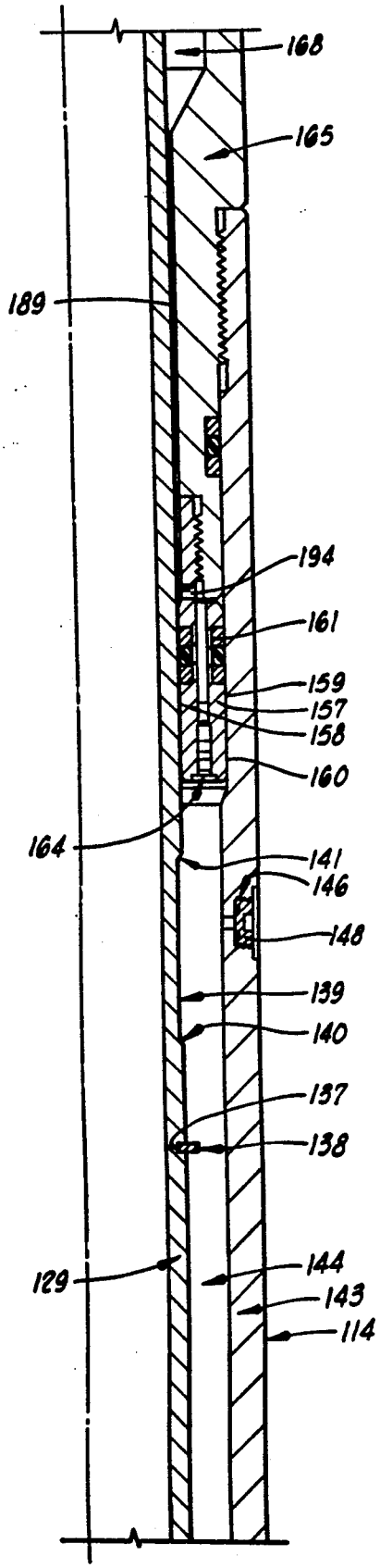
Figure 2D:
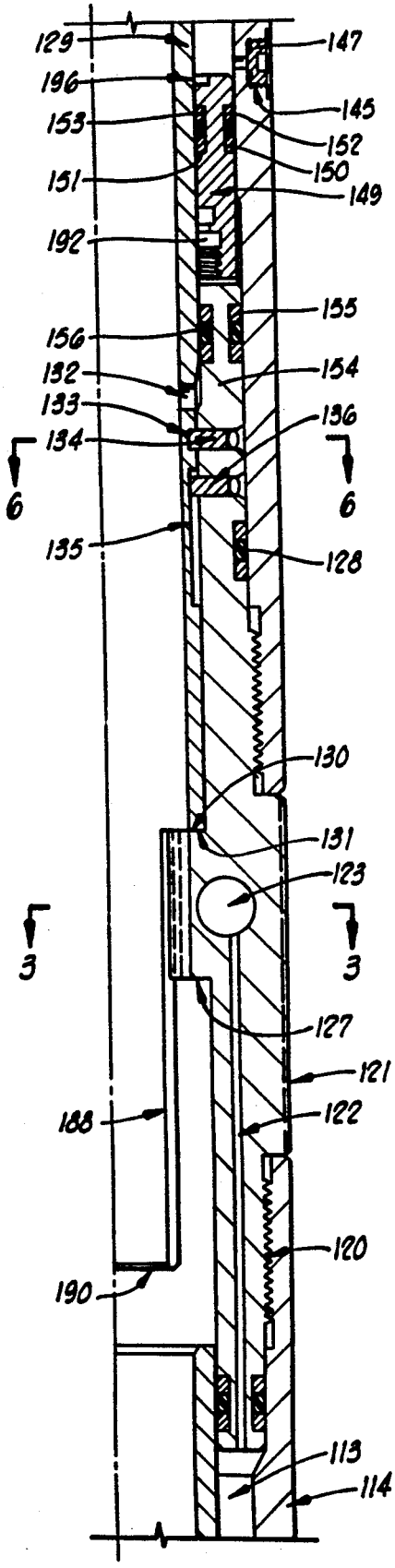
Figure 2E:
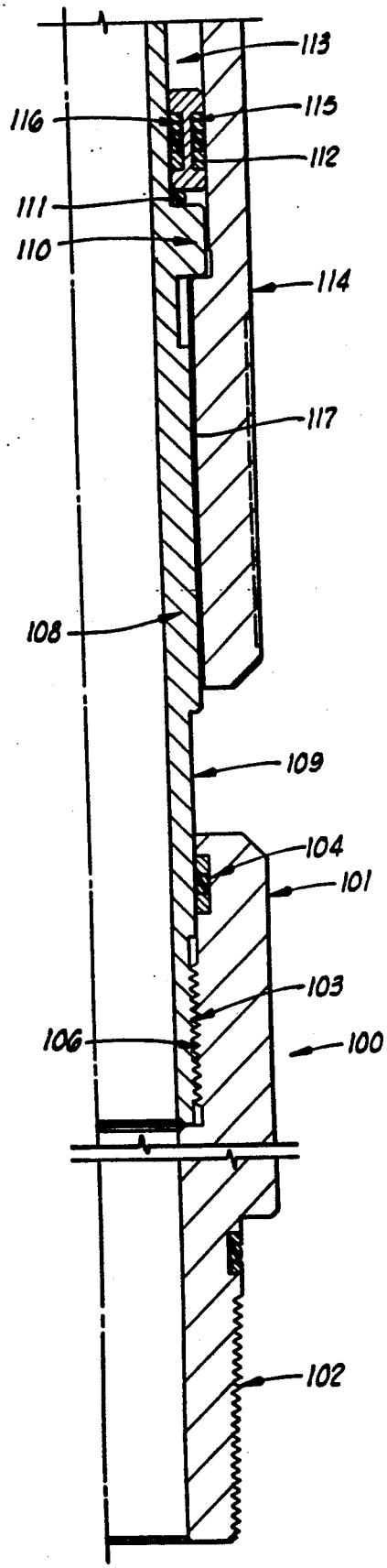

Referring to FIG. 2E, the power mandrel 100 is comprised of a bottom adapter, 101. The bottom adapter has an external thread connection means 102 at its bottom end, while at its opposite end there is provided an internal thread connection means 103, with seal means 104 directly above the internal thread connection means. Both the threaded connections and seals in this portion of the tool, as well as all other threaded connection and seals are those commonly used by the industry as will be appreciated by those skilled in the art.

The power mandrel 100 also contains an inner splined power mandrel 108 with an external thread connection means 106 on the lower end to be threaded with the internal thread end means 103 of the bottom adapter 101. The seal means 104 of the power mandrel will surround the inner splined power mandrel 108 around the outer sealing diameter 109 so that the annulus well bore fluids will be prevented from entering the tubing annulus at this point.

The remaining inner power mandrel 108 has an inner shoulder 110 and disposed on its upper end is an elastomeric member commonly referred to as an O-ring 111. Adjacent to the O-ring 111 and mounted on the top portion of the inner power mandrel is floating piston 112. The floating piston is slidably disposed in oil chamber 113, said oil chamber 113 being formed from the differential area of the outer diameter of the tubular housing 114 and the inner splined power mandrel member 108. This oil chamber is filled with oil at atmospheric pressure before the tool is run in the hole. The floating piston 112 has an elastomeric member placed in the top and bottom grooves 115 and 116, respectively.

Figure 4:
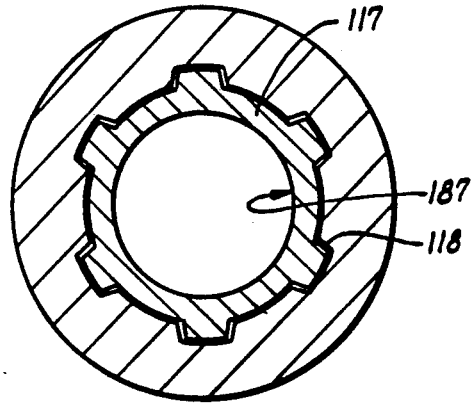
FIG. 4 comprises a sectional elevation of the splined upper mandrel.

The tubular housing member 114 generally consists of a first splined tubular member 117, which will match the grooves of the inner spline power mandrel 101. Referring to FIG. 4, the first spline tubular member 117 will have a plurality of shoulders 118 with an inner diameter smooth bore 187. Referring again to FIG. 2D, at its upper end, the tubular housing member 114 will have an internal threading connection means 120, to which tubular housing nipple member 121 will be threadily connected. The tubular housing nipple member 121 has bored there through a vertical passage 122 from its bottom, such that there is communication between the first oil chamber 113 to a communication port 123 drilled through the tubular member, at a skewed angle, which is also known as a first pressure passage means.

Figure 3:
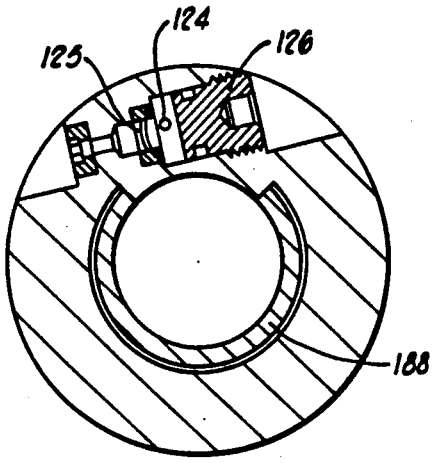
FIG. 3 comprises a sectional elevation of the rupture disk assembly.

Referring now to FIG. 3, intersecting the vertical passage 122 is a hole 124 drilled at an oblique angle to the outer tubular member. A rupture disk 125 is placed in the bore thereof. At the end of the oblique hole 124, a plug 126 is placed which will effectively seal off the annulus fluids. The vertical passage 122 enters the oblique hole 124 at a position between the plug 126 and the rupture disk 125. As shown in FIG. 2D, the tubular housing nipple 121 has an increased inner diameter at position 127, which defines a shoulder. Also, the tubular housing nipple member at its upper end has elastomeric seal means 128.

An inner operating mandrel, shown generally as 129, is longitudinally disposed above the tubular housing nipple member 121 and with a first defined shoulder 130 resting on shoulder 131 of the tubular housing nipple. The inner operating mandrel 129 also has a bored through port 132 through which the hydrostatic pressure of the tubing will be communicated.

Also contained on the inner operating mandrel 129 is a first recess 133 for inclusion of a plurality of shear pins 134. A second elongated slot 135 is provided for a second set of shear pins 136. The cut-out section 188 of the inner operating mandrel 129 terminates at shoulder 190. Referring to FIG. 2C, the inner operating mandrel 129 will also have an indented groove machined thereon, at 137, which will allow for placement of a ring 138 about the inner operating mandrel 129, or as commonly known by those skilled in the art, a "snap ring" 138. The snap ring 138 is placed around the inner operating mandrel 129 in this groove 137. The inner operating mandrel will have a recessed neck 139 formed from chamfered surfaces 140 and 141.

The outer tubular housing 114 will have a third member 143 threadily connected to the tubular nipple member 121. This third member 143 forms a chamber 144, known as the second oil chamber 144, which is disposed between the third tubular member 143 and the inner operating mandrel 129. Also, bored through the third member 143 are two ports, 145 and 146, which will allow placement of a fluid, such as hydraulic oil, into the chamber 144. This forms the second oil chamber 144. Ports 145 & 146 have contained therein fluid plugs 147 and 148 threadily engaged to prevent oil removal. Port 145 is known as the vent port and port 146 is known as the fill port.

Referring to FIG. 2D, slidably disposed in the second oil chamber 144, is a floating piston 149. A recess 196 is defined on floating piston 149. About both recesses 150 and 151 are placed seals 152 and 153. Before activation of the tool, the floating piston 149 rest against the outer ledge 154 of the tubular nipple member 121. The outer ledge 154 of the tubular nipple 121 has elastomeric sealing means on both the upper and lower sides 155, 156, respectfully.

Referring to FIG. 2C, at the top end of the second oil chamber 144, there is placed a metering cartridge 157 which comprises an annular collar having cylindrical interior and exterior edges 158 and 159, respectfully. Exterior surfaces 159 accommodates annular recess 160 therein, in which is disposed seal means 161.

A plurality of longitudinally oriented metering bores 164 extend partially through metering device 157 from the bottom thereof upwardly. A fluid metering device 157 such as is disclosed in U.S. Pat. No. 3,323,550, and is sold under the trade name of Lee Visco Jet, is disposed in each metering bore 160 at the lower end thereof.

As seen in FIG. 2B, threadily connected to the metering cartridge will be the air chamber case 165. The air chamber case has on its top side internal thread connection means 166 for make-up with the outer ported housing member 167. The air chamber 168 is formed between the air chamber case 165 and the inner operating mandrel housing 129. Since the tool is dressed at the surface, under surface conditions, air in chamber 168 is at atmospheric pressure.

The outer ported nipple 167 contains bypass port 169 bored therethrough. The outer ported nipple 167 has a ledge 170 which has placed about it a set of elastomeric seals, 171 and 172, which seals the air chamber case 165. Referring to FIG. 2A, also provided on the outer ported nipple 167, is a top adapter sub 175, on which first 173 and second 174 auxiliary ports are disposed. The neck of the top adapter sub 175 contains internal threading connection means 176 and a shoulder 177 upon which the ported mandrel can abut.

Referring to FIGS. 2A and 2B, the inner ported mandrel 178 comprises at least one bypass port 179, about which are two sets of elastomeric seals, 180 and 181, respectively and terminates with and shoulder 200. Also, at each end of the inner ported mandrel 178 are seals 182 and 183 respectively. A shoulder 185 of greater outer diameter relative to the inner ported mandrel 178 is provided. Seal means 188 are also provided. Terminating shoulder 200 will abut shoulder 177 after the inner ported mandrel has been jarred.

OPERATION OF THE PREFERRED EMBODIMENT

Returning to figure 1 of the drawings, it will be assumed that a drill stem test string is being, or has been run in the hole in a manner well known in the art; once the test string has been run to the depth of the production packer, the test string can be pressure tested. This is accomplished by utilizing the TST valve. After a successful test, the test string can be stung into the packer seal bore. Also, it may be desirable to sting into the packer bore first, and thereafter testing the test string.

At the point of stinging into the packer, the piston effect contained within the area below the production packer is eliminated because of the bypass ports contained on the present tool. In other words, as the tool string is stung into the packer bore, the excess fluid can be circulated through the bypass ports 169. On the other hand, if for some reason it becomes necessary to pick up the test string, the fluid in the casing annulus can circulate back down the annulus to below the production packer via the bypass ports 169.

Once it is time to begin testing the well, the bypass port 169 will need to be closed. Thus, weight is transmitted from the tool string, by setting down weight, to the first mandrel bottom adapter 101, which in turns transmits weight to the first inner splined power mandrel 108. This power mandrel is slidably mounted in the outer tubular housing 114.

As weight is being applied to the first power mandrel 108, the shoulder 110 of the first power mandrel 10B is urged upward against seal 111 and floating piston 112. As more weight is set down on the first inner splined power mandrel 108, the greater the amount of force is being transmitted to first oil chamber 113. The oil acts through the vertical cut through passage means section 122 of tubular nipple member 121 and is transmitted to the rupture disk 125 via the pressure passage means 122. The rupture disk 125 has a predetermined bursting strength; hence, after the predetermined amount of force transmitted via the oil chamber 113 against the rupture disk 125 has been exerted, the disk will rupture and the oil previously in the first oil chamber 113 will be emptied via an annulus port 125A out into the casing annulus.

Thus, oil has been vented out of the first oil chamber 113 and since there is no longer any resistance, the first inner splined power mandrel 108 will move up rapidly, and strike the inner operating mandrel 129 at shoulder 190. This force will act to jar the inner operating mandrel 129 and will shear pin 134. The port 132 on inner operating mandrel 129 will then be allowed to move up relative to the floating piston 149. The port 132 will then transmit the hydrostatic pressure of the tubing to the floating piston 149, an area represented by numeral 192.

Floating piston 149, being forced upward by the hydrostatic pressure of the tubing acting on the area 192, tends upward against the oil in the second oil chamber 144. The oil in the second oil chamber 144 has been placed in the tool at the surface under atmospheric pressure.

Thus, the oil is being urged out of the chamber 144 due to the difference between the tubing hydrostatic pressure and atmospheric pressure; however, the oil must flow through the metering cartridge 157. The oil enters through the flow device 164, and through annulus 158. The metering cartridge 157 causes a restriction; thus, there is a delay of several minutes from the point where the floating piston 149 begins its upward push and until the recess 139 disposed on the inner operating mandrel, and in particular the chamfered surfaces 141, reaches the metering cartridge 157. The oil is flowing into the air chamber 168 via the annular space between the air chamber case 165 and the inner operating mandrel 129, annular space shown generally at 189 via aperture 194.

Floating piston 149 will slidably travel until floating piston 149 engages snap ring 138 at recess 196. Afterwards, the inner operating mandrel 129 will move relative to the third outer tubular member 143.

In the preferred embodiment, once the recessed neck 139 reaches the metering cartridge, the oil heretofore prevented from circulating around the metering cartridge by seals 161, will in fact bypass the metering cartridge. Therefore, since there is no longer a restriction (the oil is entering into the atmospheric air chamber) the inner operating mandrel 129 will be urged up axially, contacting the inner ported mandrel 178, shown in FIG. 5D, at shoulder 198. Alternatively, the inner operating mandrel 129 can contain a smooth outer diameter (i.e. there is no recessed neck) which will still allow for mandrel 129 to be urged up axially, contacting the inner ported mandrel 178.

Figure 5A:
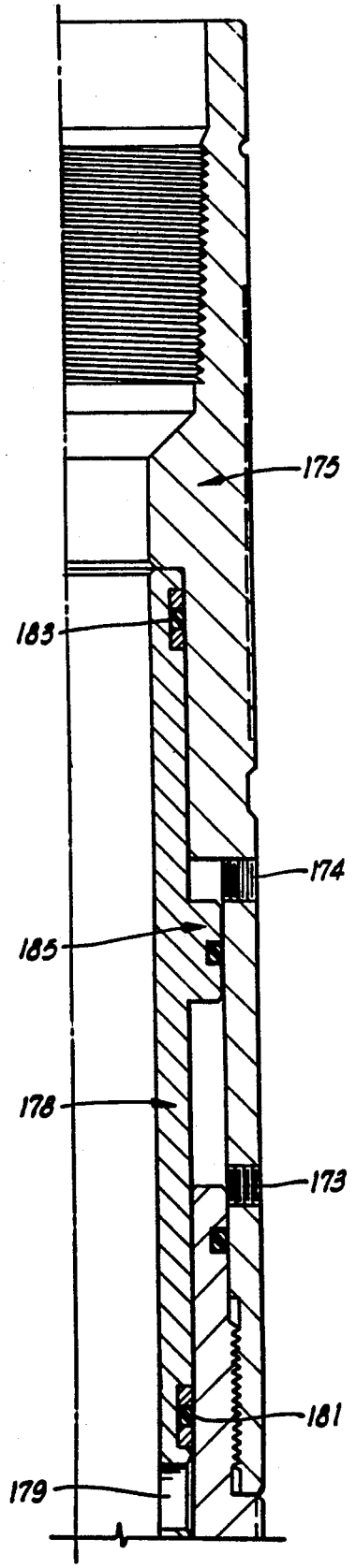
FIGS. 5A-5E comprise a vertical quarter-section elevation of the production bypass valve after the bypass ports have been closed.
Figure 5B:
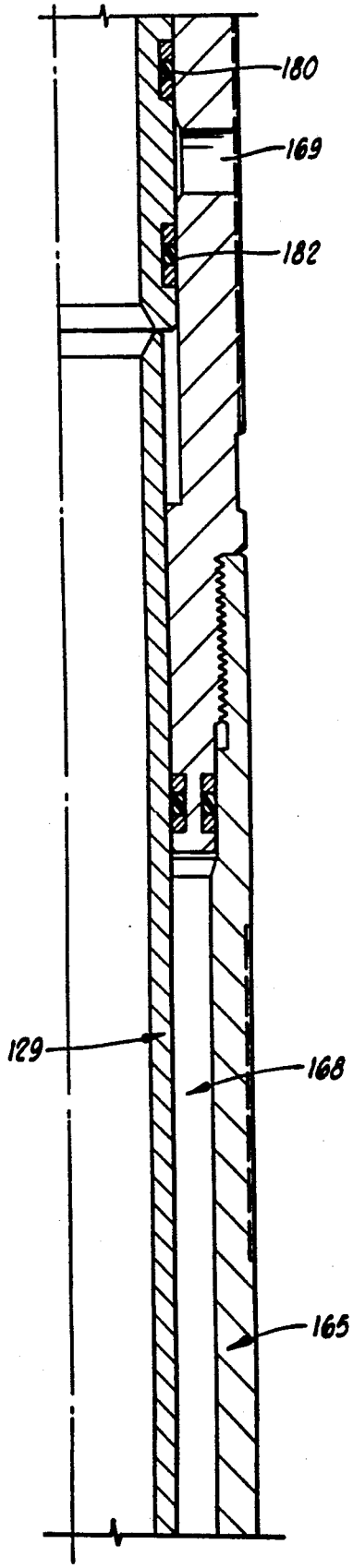
Figure 5C:
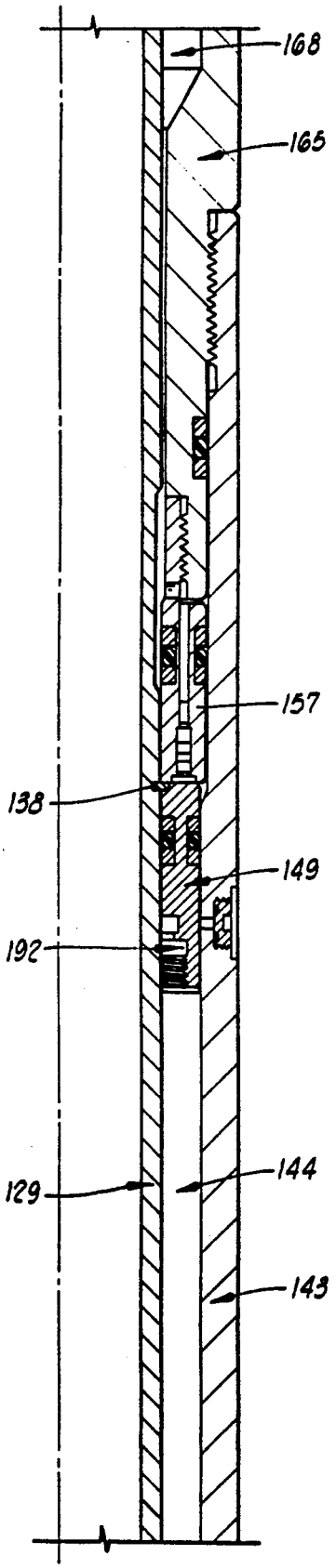
Figure 5D:
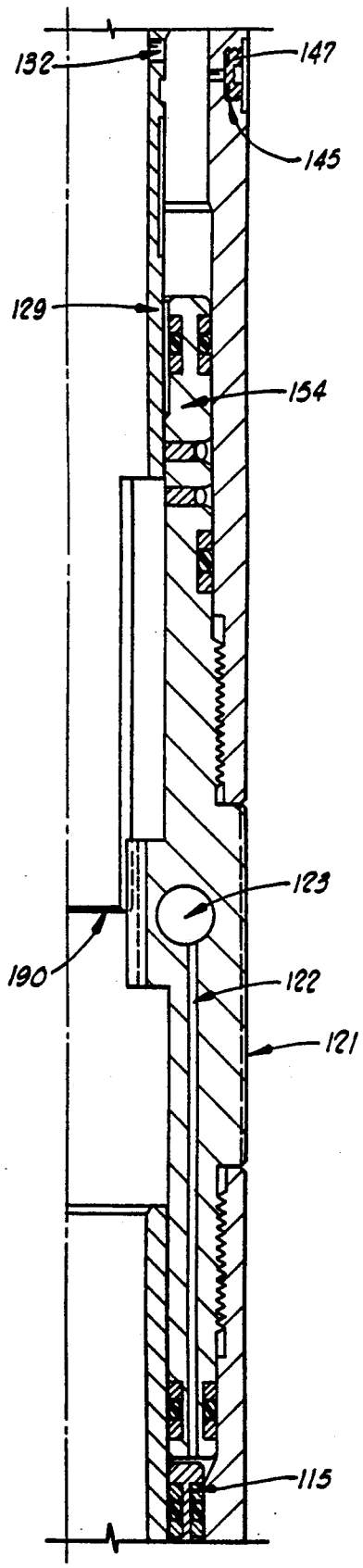
Figure 5E:
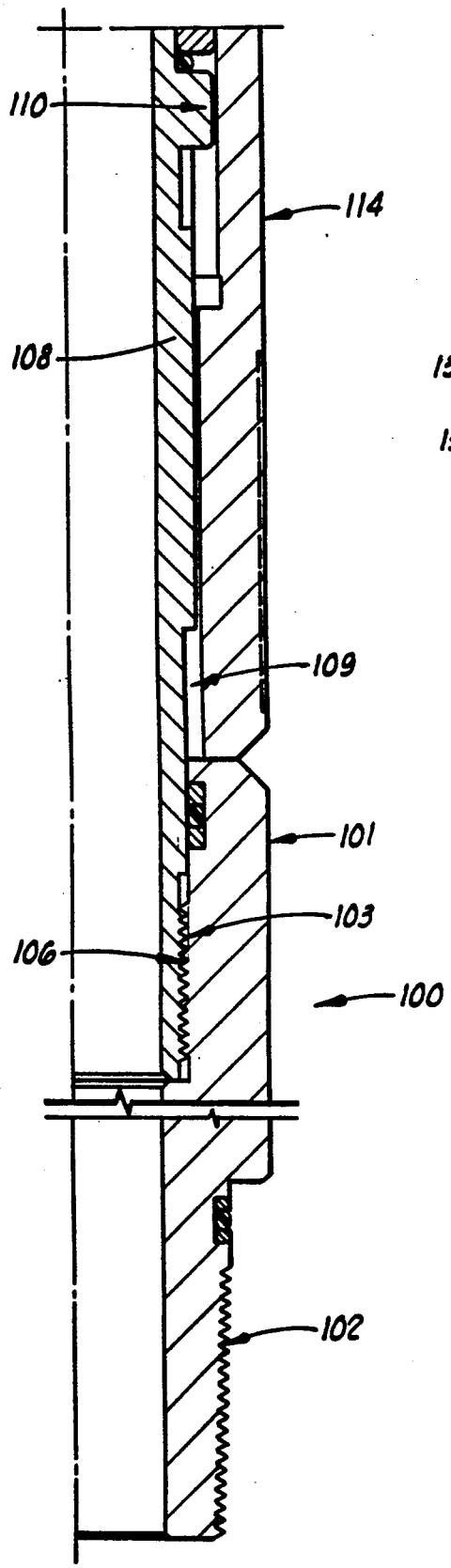
Figure 5:
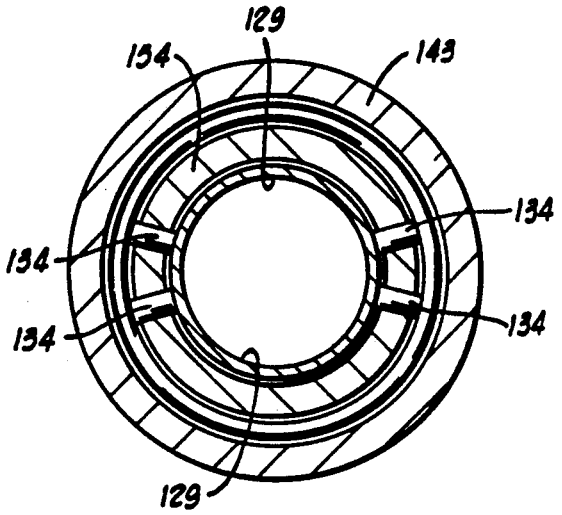

When the tool is run in the hole, the bypass ports 169 and 179 of the outer ported nipple 167 and inner ported mandrel 178 are aligned. Thus, by the jarring of the inner operating mandrel 129 and inner ported mandrel 178, the inner ported mandrel 178 will be forced into the neck of the top adapter 175, such that the shoulder 177 of the adapter will abut the shoulder 200 of the inner ported mandrel 178. Referring to FIG. 5A and 5B, with the ported mandrel 178 being in this position, elastomeric seals 180 and 182 are now aligned on either side of port 169 thereby effectively sealing the casing annulus fluid from the internal diameter of the tool and the remainder of the internal diameter of the test string.

Referring to FIG. 2A, also disclosed is a method of testing the seals 180 and 181 before the tool is run in the hole. In order to test the seals 180 and 181, the design of the present invention allows for an auxiliary pump to be hooked up to external auxiliary port 173. Pressure can then be applied to the auxiliary port 173, with pressure being transmitted to the shoulder 185 of the inner ported mandrel 178 as the shoulder rests against the edge of the ported nipple 186.

The pressure applied will tend to make the shoulder 185 travel longitudinally up, relative to the outer ported housing 167 and top adapter 175, thereby closing the bypass ports 169. At this point, seal 180 and 182 will traverse bypass port 169, as shown in figure 5B. Thus, pressure can now be applied to bypass port 169 and an effective test of seals 180 and 182 can be performed. After the test, the inner ported mandrel 178 can be longitudinally moved down so that port 179 of the inner ported mandrel 178 is aligned with a bypass port 169 of the outer ported housing member 167, and the tool can be run into the hole, as shown in FIG. 2A and 2B. Thus, it is apparent that the apparatus of the present invention readily achieves the advantages mentioned as well as those inherent therein. While certain preferred embodiments of the invention have been illustrated for the purpose of this disclosure, numerous changes in the arrangement and construction of parts may be made by those skilled in the art, which changes are embodied within the scope and spirit of the present invention as defined by the appended claims.

What is claimed is:

1. A well tool apparatus comprising:

a tubular housing having a portion defining at least one bypass port;

a power mandrel slidably disposed within said tubular housing;

an operating mandrel slidably disposed within said tubular housing;

means for axially urging said power mandrel into said operating mandrel;

an inner sleeve mandrel having a portion defining a bypass port, said inner mandrel being slidably disposed with said tubular housing, the bypass port in said inner sleeve mandrel being initially aligned with the bypass port in said tubular housing; and means for sliding said inner sleeve mandrel relative to said tubular housing so that the bypass port defined in said tubular housing and the bypass port on the inner sleeve mandrel are no longer aligned.

2. A well tool apparatus comprising:

a tubular housing having a portion defining at least one bypass port;

power mandrel disposed in said tubular housing;

an operating mandrel cooperating with said power mandrel, said operating mandrel defining an oil chamber case filled with an oil at atmospheric conditions and an air chamber case filled with air at atmospheric conditions;

means for axially urging said power mandrel into said operating mandrel;

means for restricting flow of the oil from said oil chamber case to said air chamber case;

means for traversing said operating mandrel relative to said tubular housing;

a ported mandrel with a top end and bottom end, disposed in said tubular housing, said ported mandrel having a portion containing at least one bypass port, the bypass port being aligned longitudinally with said bypass port of said tubular housing; and means for sliding said ported mandrel relative to said tubular housing so that the bypass port of said ported mandrel and the bypass port of said tubular housing are no longer aligned.

3. The apparatus of claim 2, wherein said power mandrel comprises:

an outer member having a first and a second end, the first end and second end having thread connections; second end having thread connections;

an elastomeric seal disposed on said outer member at the first end of the thread connection means;

an inner member having a portion defining a recessed shoulder, said inner member being threadily connected at the first end of said outer member, said outer tubular and said inner member forming a first chamber;

means for sealing the recessed shoulder;

a piston disposed with in the chamber; and a second chamber case being formed from the area between said outer member and the inner member.

4. The apparatus of claim 3, wherein said second chamber case is filled with a hydraulic oil at atmospheric pressure.

5. The apparatus of claim 4, wherein said inner member has defined a portion containing splined grooves.

6. The apparatus of claim 5 further comprising:

a second operating mandrel, said second operating mandrel including:

an upper shoulder with a diameter less than the diameter of said first mandrel;

an elongated body member having portions containing:

a bypass port;

a first slot for containing a first shear pin;

a second elongated slot for containing a second shear pin;

an inner recess groove; and a recessed neck defined on said elongated body.

7. The apparatus of claim 6, wherein said ported mandrel contains a first and second seal means placed about said bypass ports.

8. The apparatus of claim 7, wherein said ported mandrel further contains a third and fourth seal means disposed on the top and bottom of said ported mandrel.

9. The apparatus of claim 8, wherein said ported mandrel has defined further a shoulder, the shoulder being of larger outer diameter than the outer diameter of said ported mandrel.

10. A well tool apparatus, comprising:

a tubular housing having a portion containing at least one bypass port;

a power mandrel having an outer member with a first and second end, the outer member having thread connection means disposed at the first and second ends, an O-ring disposed about said outer member at the first end of said thread connection means, an inner splined member being threadily connected to the outer member at the second end, the inner splined member having a recessed shoulder, an O-ring being placed around said recessed shoulder, a piston placed adjacent to said O-ring around said recessed shoulder, said power mandrel and the piston forming a first and second chamber with said outer tubular housing;

an operating mandrel having an upper shoulder with a diameter less than the diameter of said power mandrel, a slot for containing a first shear pin, and an elongated slot for containing a second sear pin, an inner recessed groove, and a recessed neck;

means, threadily connected with said power mandrel and said outer tubular housing, for jarring said power mandrel with said outer tubular housing;

means, adapted between said tubular housing and said power mandrel, for traversing said operating mandrel relative to said outer tubular housing;

a ported mandrel disposed in said tubular housing, said ported mandrel containing at least one bypass port being aligned longitudinally with said bypass port of said tubular housing, a first and second O-ring seal being placed about said ported mandrel, and a third and fourth O-ring seal being placed about each end of said ported mandrel; and means, adapted between said tubular housing and said second mandrel, for sliding said ported mandrel relative to said tubular housing so that the bypass port of said ported mandrel and the bypass port of said tubular housing are no longer aligned.

11. The apparatus of claim 10, wherein said first chamber is filled with an oil at atmospheric pressure.

12. The apparatus of claim 11, wherein said second chamber is filled with air at atmospheric pressure.

13. The apparatus of claim 12, wherein said jarring means comprises:

a nipple disposed between said first and second mandrels, said nipple containing a longitudinal bore, the longitudinal bore being threadily connected to the oil chamber case, and said nipple having an orifice forming a passageway;

a rupture disk being disposed in the orifice, the longitudinal bore being connected there through so that the oil acts against said rupture disk; and a plug being threadily connected to the orifice so that annulus fluid pressure is prevented from entering into the orifice.

14. The apparatus of claim 13, further comprising means for restricting flow of the oil wherein said restricting means includes:

a cylindrical housing having a metering passage extending from said chamber to said cavity; and a fluid metering device disposed in said metering passage adapted to restrict the flow of sad metering fluid there through into said cavity.

15. The apparatus of claim 14, wherein said means for traversing said second mandrel relative to said outer tubular housing comprises:

a snap ring being placed in the inner recessed groove of the second operating mandrel, so that said piston's outer end will come into contact with said snap ring, said second operating mandrel will travel with respect to said tubular housing until said recessed neck, located on said second mandrel, comes into contact with said fluid metering device so that the oil bypasses said metering device into said air chamber.

16. The apparatus of claim 15, wherein said means for sliding said ported mandrel relative to said tubular housing comprises:

a top adapter threadily connected to said tubular housing;

means for forcing said recessed neck past said metering device thereby allowing the oil to bypass said metering device and flow into said air chamber.

17. A method of testing a downhole tool, comprising the steps of:

applying pressure to a top adapter defining a port;

sliding an inner mandrel having a portion defining a port, said sliding of said inner mandrel being responsive to the pressure being applied to the top adapter;

sealing the port located on the mandrel; and determining if seals on the inner mandrel have sealed the top adapter.

18. A method of closing bypass fluid port in a downhole tool located on a tubing string, comprising the steps of:

setting down weight of the tubing string relative to the downhole tool causing an oil located in a chamber to undergo a pressure increase;

transmitting the oil pressure to a rupture disk;

rupturing the disk, thereby allowing oil pressure to be relieved and allowing a first mandrel to travel longitudinally up, jarring a second mandrel;

shearing a pin on said second mandrel, allowing said second mandrel to expose a port to hydrostatic tubing pressure;

forcing the oil out of an oil chamber case by a hydrostatic annulus pressure;

restricting the flow of the oil from the oil chamber case;

jarring a ported mandrel, said ported mandrel being seated in a ported nipple so that said jarring will close said port in said mandrel relative to the port in said nipple.

19. A well tool apparatus comprising:

a tubular housing having a portion defining at least one bypass port;

a power mandrel slidably disposed within said tubular housing;

an operating mandrel slidably disposed within said tubular housing;

means for axially urging said power mandrel into said operating mandrel;

an inner sleeve mandrel having a portion defining a bypass port, said inner sleeve mandrel being slidably disposed within said tubular housing, the bypass port in said inner sleeve mandrel being initially aligned with the bypass port in said tubular housing, and said inner sleeve mandrel also having a portion defining a recessed neck therein;

means for sliding said inner sleeve mandrel relative to said tubular housing so that the bypass port defined in said tubular housing and the bypass port in said inner sleeve mandrel are no longer aligned;

an oil chamber case filled with oil at atmospheric pressure, said oil chamber case being defined by an inner sleeve mandrel and said tubular housing, said oil chamber case defining an oil chamber;

a power piston slidably disposed in said oil chamber case, said power piston being exposed to a hydrostatic pressure contained within a tubing string through said bypass ports in said tubular housing and said inner sleeve mandrel;

a metering cartridge disposed at one end of said oil chamber case, through which the oil in said oil chamber case will flow; and an air chamber case being defined by said tubular housing and said power mandrel, said air chamber case being filled with air at atmospheric pressure s that the oil flows into said air chamber case until the recessed neck on said inner sleeve mandrel reaches said metering cartridge which allows unrestricted flow of the oil from said oil chamber case into said air chamber case allowing said power mandrel to jar said inner sleeve mandrel.

* * * * *